US010883215B2

(12) United States Patent
Takashima et al.

(10) Patent No.: US 10,883,215 B2
(45) Date of Patent: Jan. 5, 2021

(54) WASHING MACHINE AND CONTROLLING METHOD THEREOF

(71) Applicant: Samsung Electronics Co., Ltd., Gyeonggi-do (KR)

(72) Inventors: Yoshinori Takashima, Yokohama (JP); Takehiro Nakanishi, Yokohama (JP); Tomoyuki Okuno, Yokohama (JP); Toshihiro Kamii, Yokohama (JP); Katsuyuki Shimakage, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 439 days.

(21) Appl. No.: 15/442,498

(22) Filed: Feb. 24, 2017

(65) Prior Publication Data

US 2017/0247826 A1 Aug. 31, 2017

(30) Foreign Application Priority Data

Feb. 25, 2016 (JP) ..... 2016-34196
Aug. 10, 2016 (JP) ..... 2016-157299
Dec. 7, 2016 (KR) ..... 10-2016-0165695

(51) Int. Cl.
*D06F 33/02* (2006.01)
*D06F 37/12* (2006.01)
(Continued)

(52) U.S. Cl.
CPC ..... *D06F 33/00* (2013.01); *D06F 34/18* (2020.02); *D06F 34/22* (2020.02); *D06F 34/28* (2020.02);
(Continued)

(58) Field of Classification Search
CPC ..... D06F 33/02; D06F 35/005; D06F 37/12; D06F 37/203; D06F 39/002;
(Continued)

(56) References Cited

U.S. PATENT DOCUMENTS 6,516,484 B2 2/2003 Kwon
8,910,335 B2 12/2014 Kim et al.
(Continued)

FOREIGN PATENT DOCUMENTS

CN 1699671 A 11/2005
CN 102828380 A 12/2012
(Continued)

OTHER PUBLICATIONS

Supplementary European Search Report dated Oct. 10, 2018 in connection with European Patent Application No. 17 75 6810, 10 pages.
(Continued)

*Primary Examiner* — Benjamin L Osterhout

(57) ABSTRACT

In accordance with one aspect of the present disclosure, a washing machine includes a rotating tub configured to accommodate laundry, a water supply pipe configured to spray water over a surface of the laundry. The washing machine also includes a controller configured to execute a water supply cycle in which an operation of each of the rotating tub and the water supply pipe is controlled and water is supplied to the rotating tub. The washing machine further includes a wash cycle in which the laundry is washed and the controller executes a first cycle in which the rotating tub is rotated faster than a rotational speed in the wash cycle so as to discharge air contained inside the laundry before the wash cycle is terminated.

20 Claims, 15 Drawing Sheets

(51) Int. Cl.

| | |
|---|---|
| ***D06F 37/20*** | (2006.01) |
| ***D06F 39/08*** | (2006.01) |
| ***D06F 37/42*** | (2006.01) |
| ***D06F 37/30*** | (2020.01) |
| ***D06F 39/00*** | (2020.01) |
| ***D06F 35/00*** | (2006.01) |
| ***D06F 37/36*** | (2006.01) |
| ***D06F 33/00*** | (2020.01) |
| *D06F 34/18* | (2020.01) |
| *D06F 34/22* | (2020.01) |
| *D06F 34/28* | (2020.01) |

(52) U.S. Cl.
CPC ..... *D06F 35/005* (2013.01); *D06F 37/12* (2013.01); *D06F 37/203* (2013.01); *D06F 37/304* (2013.01); *D06F 37/36* (2013.01); *D06F 39/088* (2013.01)

(58) Field of Classification Search
CPC .... D06F 37/304; D06F 39/005; D06F 39/088; D06F 37/36; D06F 33/00; D06F 34/18; D06F 34/22; D06F 34/28
See application file for complete search history.

(56) References Cited

U.S. PATENT DOCUMENTS

2005/0015891 A1* 1/2005 Koo ..... D06F 33/02 8/159
2005/0081573 A1* 4/2005 Han ..... D06F 37/304 68/12.02
2005/0229951 A1* 10/2005 Park ..... B08B 9/08 134/22.1
2005/0257576 A1 11/2005 Omura et al.
2006/0016021 A1 1/2006 Kim
2006/0021393 A1* 2/2006 Oda ..... D06F 39/006 68/231
2006/0186222 A1 8/2006 Ikemizu et al.
2010/0242186 A1 9/2010 Kim et al.
2010/0325815 A1* 12/2010 Im ..... D06F 33/02 8/159
2011/0192655 A1* 8/2011 Kim ..... D06F 37/12 177/1
2015/0101668 A1 4/2015 Janke et al.

FOREIGN PATENT DOCUMENTS

| | | | |
|---|---|---|---|
| JP | 2000-000389 | A | 1/2000 |
| KR | 10-0743763 | B1 | 7/2007 |
| KR | 10-2012-0028746 | A | 3/2012 |
| KR | 1606046 | B1 | 2/2016 |
| KR | 1597527 | B1 | 3/2016 |

OTHER PUBLICATIONS

International Search Report dated May 30, 2017 in connection with International Patent Application No. PCT/KR2017/001974.
Office Action dated Dec. 4, 2019 in connection with Chinese Patent Application No. 201780004496.1, 18 pages.
Notification of the Second Office Action in connection with China Application No. 201780004496.1 dated Jul. 17, 2020 15 pages.

* cited by examiner

WASHING MACHINE AND CONTROLLING METHOD THEREOF

CROSS-REFERENCE TO RELATED APPLICATION(S) AND CLAIM OF PRIORITY

The present application is related to and claims the benefit of Japan Patent Application Nos. 2016-34196 and 2016-157299, filed on Feb. 25, 2016 and Aug. 10, 2016, respectively, in the Japan Patent Office, and Korean Patent Application No. 2016-0165695, filed on Dec. 7, 2016 in the Korean Intellectual Property Office, each of which is incorporated herein by reference in its entirety.

BACKGROUND

1. Field

Embodiments of the present disclosure relate to a washing machine, and more particularly, to a washing machine and a controlling method thereof, which are capable of more efficiently performing washing by rapidly rotating laundry to eliminate air contained inside the laundry prior to execution of a water supply cycle.

2. Description of the Related Art

Japanese Patent Application Publication No. 2000-389 (hereinafter, Patent Document 1), discloses a washing machine comprising a rotating tub configured to accommodate laundry, a water tank configured to rotatably accommodate the rotating tub, a motor configured to rotate the rotating tub, and a water supplier configured to supply water to the water tank. To discharge air contained inside the laundry before a wash cycle is executed, the washing machine disclosed in Patent Document 1 intermittently rotates the rotating tub with a water level lower than that in the wash cycle, thereby raising and lowering a surface of water.

SUMMARY

However, in Patent Document 1, discharging air by raising and lowering the surface of water has an adverse effect on laundry having feathers, such as a feather comforter. Feather products typically contain air and a high density woven surface fabric for containing the feathers. Such feather product laundry floats to the surface of the water while the air is discharged. If the air is not sufficiently discharged, any contamination in the laundry will not be effectively eliminated.

To address these deficiencies, it is an object to provide a washing machine and a controlling method thereof, which are capable of more efficiently performing washing by efficiently discharging air even when washing feather product laundry.

To attain the above described object, in accordance with the present disclosure, an air discharge cycle (that is, a first cycle) is executed to rotate a rotating tub at a speed faster than that of a rotating operation in a wash cycle.

Additional aspects of the disclosure will be set forth in part in the description which follows and, in part, will be obvious from the description, or may be learned by practice of the disclosure.

Particularly, the present disclosure may include a rotating tub configured to accommodate laundry, a water tank configured to rotatably accommodate the rotating tub, a pulsator rotatably disposed at a bottom surface inside the rotating tub, a motor configured to rotate the rotating tub and the pulsator, a water supply pipe configured to supply water to the water tank or the rotating tub, a drain pipe configured to flow out water accommodated in the water tank or the rotating tub, and a controller configured to execute a water supply cycle in which the water is supplied to the water tank or the rotating tub up to a specific water level through the water supply pipe, and a wash cycle in which the motor is controlled to perform a rotational operation of rotating at least one of the rotating tub and the pulsator after the water supply cycle is executed.

Also, the controller may perform the rotational operation of rotating the rotating tub to rotate the rotating tub at a rotational speed faster than that in the wash cycle, thereby effectively discharging water inside laundry.

Therefore, in accordance with the present disclosure, even when the laundry is a feather product, it may be compressed and simultaneously adhered to an inner lateral surface of the rotating tub by a centrifugal force and thus air contained in the laundry may be discharged therefrom such that the laundry may be prevented from floating to a surface of water and further a cleaning power may be more improved.

In Embodiment 2, a rotational speed of the rotating tub may be equal to or more than 300 revolutions per minute (rpm) and equal to or less than 500 rpm in a first cycle.

In Embodiment 3 in association with Embodiment 1 or 2, the pulsator may be a rotary wing.

In Embodiment 4 in association with any one of Embodiments 1 to 3, spraying the water over a surface of the laundry accommodated in the rotating tub may be included. Therefore, the controller may execute a wetting cycle (that is, a second cycle) in which the water is sprayed over the surface of the laundry.

Consequently, even when the laundry is the feather product, a gap between yarns of a high density woven surface fabric may be blocked by the water through the wetting cycle so that the laundry may be prevented from floating resulting from a penetration of air from an outside of the surface fabric into an inside thereof after the first cycle and the second cycle.

In Embodiment 5 in association with the washing machine of Embodiment 4, the controller may execute the wetting cycle before the water supply cycle is terminated.

In such a case, after the water supply cycle is terminated, the laundry may be effectively prevented from floating to the water due to the penetration of air from the outside of the surface fabric of the laundry into the inside thereof.

In Embodiment 6 in association with the washing machine of Embodiment 5, the water supply pipe may be configured to supply the water toward the inner lateral surface of the rotating tub or neighborhood thereof, and it may be also used in the wetting cycle.

In such a case, since the water, which is supplied while the water supply cycle is executed, may be likely to directly come into contact with the laundry, the penetration of air into the inside of the laundry may be effectively prevented after the water begins to be supplied.

Also, there is no need to separately install a wetting water supply pipe for use in the wetting cycle so that the number of components and the like may be decreased to reduce manufacturing costs by virtue of a simplified structure of the washing machine.

In Embodiment 7 in association with any one of Embodiments 4 to 6, a sum of a spray width of the water, which is sprayed over a bottom surface of the rotating tub by the water supply pipe, in forward and backward directions, and a spray width of the water, which is sprayed toward a lateral surface of the rotating tub by the water supply pipe, in a vertical direction may be set to be equal to or greater than ⅓ of a width of the bottom surface of the rotating tub. Also, a sum of a spray width of the water, which is sprayed over the bottom surface of the rotating tub by the water supply pipe, in a horizontal direction, and a spray width of the water, which is sprayed toward the lateral surface of the rotating tub, in the vertical direction may be set to be equal to or greater than ⅓ of the width of the bottom surface of the rotating tub.

In such a case, since the sum of the spray width of the wetting device in the forward and backward directions against the bottom surface of the rotating tub and the spray width of the wetting device in the vertical direction against the lateral surface of the rotating tub, and the sum of the spray width of the wetting device in the forward and backward directions against the bottom surface of the rotating tub and the spray width of the wetting device in the vertical direction against the lateral surface of the rotating tub are large, the water may be more widely sprayed over the surface of the laundry compared to that the spray width is set to be less than ⅓ of the width of the bottom surface of the rotating tub. Consequently, the water may be effectively uniformly distributed on the laundry in the wetting cycle so that an amount of the water required for the wetting cycle may be reduced.

In Embodiment 8 in association with Embodiment 4 or 5, the wetting device may spray the water, which is accommodated in the water tank or the rotating tub, over an upper side of the laundry inside the rotating tub, and the controller may spray the water, which is accommodated in the water tank or the rotating tub, over the upper side of the laundry inside the rotating tub while the wetting cycle is executed.

In such a case, the water, which is accommodated in the water tank or the rotating tub, may flow from the upper side to a lower side of the laundry so that it is possible to uniformly spray the water over the surface of the laundry.

Embodiment 9 in association with Embodiment 5 or 6 may further include a water level sensor configured to measure a water level inside the water tank or the rotating tub, the wetting device may spray the water being supplied over the surface of the laundry, and the controller may execute the wetting cycle before an air discharge cycle is terminated.

Also, in the wetting cycle, the controller may perform at least one of a water supply stop control of terminating the wetting cycle when the water level measured by the water level sensor is equal to or greater than a predetermined water supply stop threshold, and a drain control of flowing out the water accommodated in the water tank or the rotating tub through a drain device when the water level measured by the water level sensor is equal to or greater than a predetermined drain threshold.

When the water supply stop threshold and the drain threshold are set and the drain control is performed, the water may be prevented from leaking from the water tank in the air discharge cycle (that is, the first cycle).

Embodiment 10 in association with Embodiment 8 may further include a water level sensor configured to measure a water level inside the water tank or the rotating tub, and the controller may execute the wetting cycle before the air discharge cycle is terminated, and further the water supply cycle, in which the water is supplied to the water tank or the rotating tub, by the water supply device before the wetting cycle is executed.

Also, in the water supply cycle, the controller may perform at least one of a water supply stop control of terminating the water supply cycle when the water level measured by the water level sensor is equal to or greater than a predetermined water supply stop threshold, and a drain control of flowing out the water accommodated in the water tank or the rotating tub when the water level measured by the water level sensor is equal to or greater than a predetermined drain threshold.

As such, the water supply stop control and the drain control may be executed and the water supply stop threshold may be set so that the water may be prevented from leaking from the water tank and a water leak may be prevented.

In Embodiment 11 in association with Embodiments 4 to 10, the controller may simultaneously execute a rotational operation, in which at least one of the rotating tub and the pulsator is rotated, together with the wetting cycle.

Consequently, even when the water is not sprayed only in some directions inside the rotating tub, there is an effect in which the water may be uniformly sprayed over the laundry.

In Embodiment 12 in association with Embodiment 11, a rotational speed of the rotational operation in the wetting cycle may be equal to or less than 300 rpm.

Comparing to when the rotational speed of the rotational operation is set over 300 rpm, a phenomenon in which the water splashes to the outside may be reduced so that there is an effect in which a water leak may be prevented.

Embodiment 13 in association with any one of Embodiments 1 to 12 may further include a circulation device configured to spray the water, which is accommodated in the water tank or the rotating tub, over the upper side of the laundry inside the rotating tub.

Also, the wash cycle may be executed to perform a first rotational operation in which the rotating tub and the pulsator are rotated together, and at the same time, spraying of the water, which is accommodated in the water tank or the rotating tub, over the upper side of the laundry inside the rotating tub under the control of the circulation device.

In such a case, since the water flows from the upper side to the lower side of the laundry, cleaning power may be improved in comparison with a case in which only the rotating tub is rotated without the spraying of the water over the laundry.

In Embodiment 14 in association with any one of Embodiments 1 to 13, the wash cycle may be executed by alternately repetitively performing the first rotational operation in which the rotating tub is rotated together with the pulsator, and a second rotational operation in which only the pulsator is rotated.

In such a case, since the first and second rotational operations are alternately repetitively performed, the laundry adhered to the inner lateral surface of the rotating tub may be more easily spaced apart therefrom so that the cleaning power may be improved in comparison with a case in which only the first rotational operation is performed.

Embodiment 15 in association with any one of Embodiments 1 to 14 may further include an abnormality detection device configured to detect abnormality of the washing machine, and the controller may stop the rotational operation of the rotating tub when abnormality is detected by the abnormality detection device while the air discharge cycle is executed.

As described above, since the rotation of the rotating tub is stopped when the abnormality of the washing machine is detected, it may be possible to prevent a problem resulting from the abnormality.

Embodiment 16 in association with any one of Embodiments 1 to 15 may further include a display configured to display a current state of the washing machine, and the controller may execute a spin-drying cycle in which the rotating tub is rotated after the wash cycle is executed.

Also, the display may display the wetting cycle and the air discharge cycle, and further it may differently display the wetting cycle and the air discharge cycle from other cycles of the washing machine.

Consequently, there is an effect in which a user may easily understand a cycle being currently executed, whether the cycle corresponds to the wetting cycle, the water supply cycle, or the other cycles, through only recognition of the display.

Embodiment 17 in association with any one of Embodiments 1 to 16 may further include a detection device configured to detect a predetermined physical amount, and the controller may calculate a weight of the laundry on the basis of the physical amount detected by the detection device when the rotational operation is performed upon execution of the air discharge cycle.

Therefore, since a weight of laundry may be calculated on the basis of a physical amount detected upon a rotating operation, a motor may not need to perform a separate rotating operation so as to calculate the weight of the laundry so that a time required for washing may be reduced.

In accordance with the present disclosure, even when laundry is a feather product, air contained inside the laundry is discharged therefrom by a centrifugal force through an air discharge cycle and thus the laundry is prevented from floating to a surface of water so that there is an advantage in which washing may be more effectively performed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device.

Embodiments described herein and configurations shown in the accompanying drawings are preferred examples of the present disclosure, and various modified examples may be made at the time of filing of the present application to substitute the embodiments and the accompanying drawings of the present disclosure.

Also, the terms used herein are used to describe the embodiments and are not intended to restrict and/or limit the present disclosure. The singular forms include plural forms unless the context clearly notes otherwise.

In this description, the terms "comprising," "configured with," "having," or the like are used to specify that a feature, a number, a step, an operation, a component, an element, or a combination thereof described herein exists, and they do not preclude the presence or addition of one or more other features, numbers, steps, operations, components, elements, or combinations thereof.

Further, it should be understood that terms including ordinals such as "a first," "a second," and the like may be used herein to describe various components, but the components are not limited to the terms, and these are used only for the purpose of distinguishing one component from another. For example, without departing from the scope of the present disclosure, a first component may be referred to as a second component, and similarly, the second component may also be referred to as the first component. The term "and/or" includes a combination of a plurality of related listed items or any item of the plurality of related listed items.

Hereinafter, embodiments of the present disclosure will be described in detail with reference to the accompanying drawings, which will be readily apparent to those skilled in the art to which the present invention pertains. Further, portions in the accompanying drawings, which are not related to the description, will be omitted in order to clearly describe the present disclosure.

Embodiment 1

Figure 1:
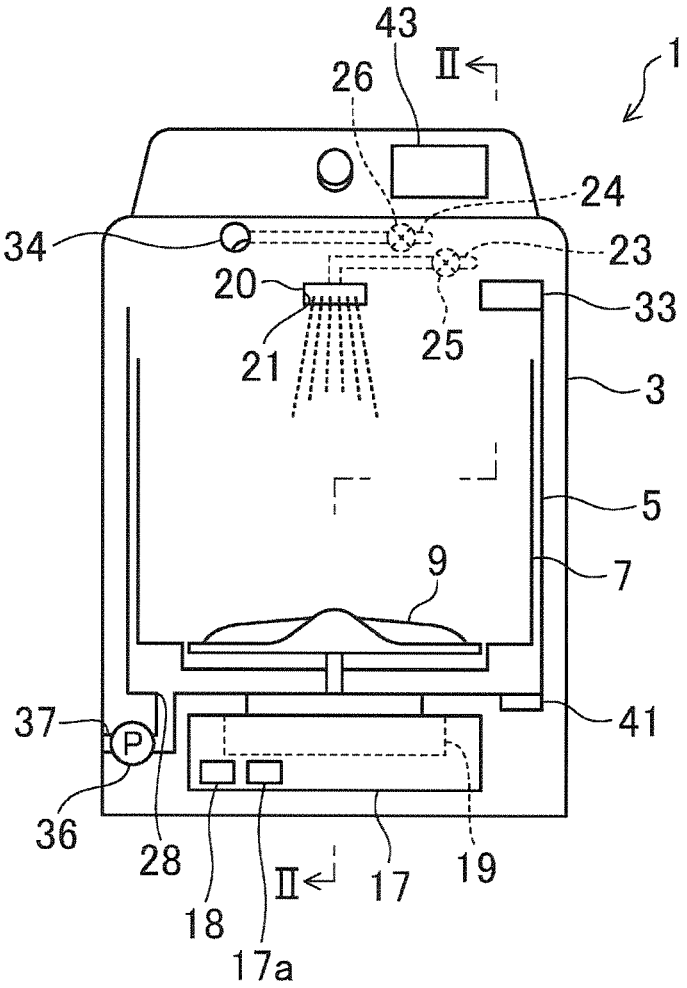
FIGS. 1 and 2 are cross-sectional views of a washing in accordance with one embodiment of the present disclosure.
Figure 2:
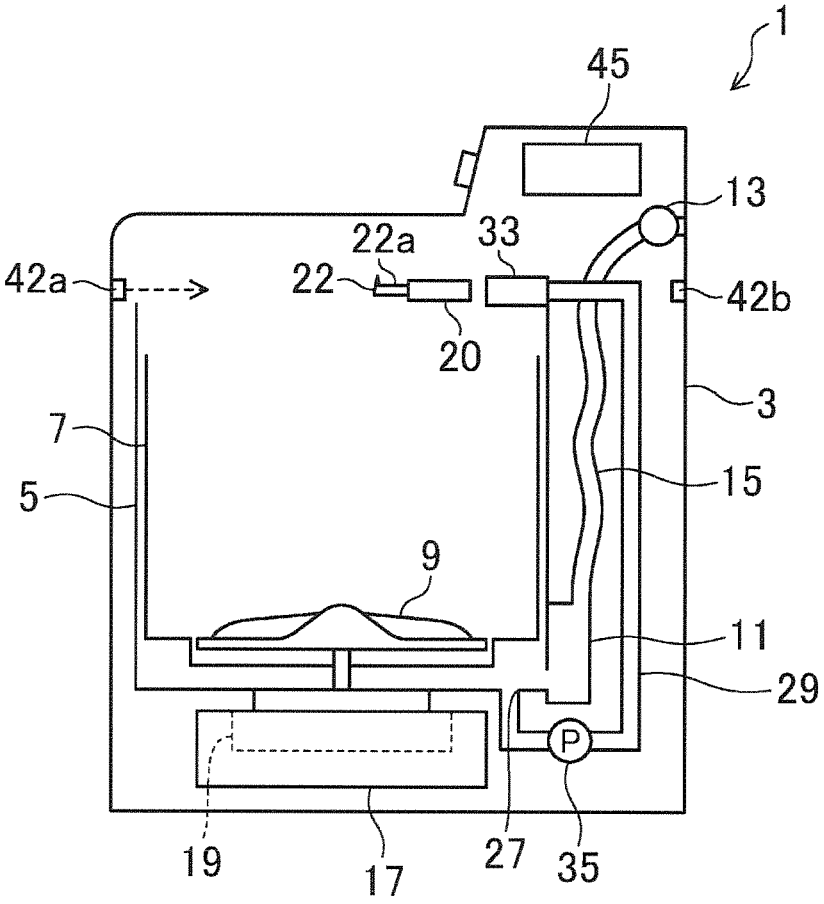

FIGS. 1 and 2 are cross-sectional views of a washing machine 1 according to Embodiment 1 of the present disclosure.

The washing machine 1 includes an outer frame 3 and a water tank 5 installed inside the outer frame 3, and the water tank 5 may be formed in a cylindrical shape that is open to one side.

Also, the water tank 5 may be supported from four upper corners of the outer frame 3 in a suspension state by a vibration-proofing device (not shown) that is configured with a suspension rod (not shown) and a coil spring or sliding ring.

Further, a rotating tub 7 of a cylindrical shape, which is open to one side, is rotatably accommodated in the water tank 5 in a direction the same as that of the water tank 5. The rotating tub 7 has a diameter of about 650 mm and a depth of about 500 mm. A pulsator 9 may be installed at an inner bottom wall of the rotating tub 7 and rotate to generate a water current therein.

The rotating tub 7 is a space in which washing and spin-drying are performed and is referred to as a washing and spin-drying tub, and the pulsator 9 is referred to as a rotation device because of rotating to generate the water current. For convenience, they respectively refer to the rotating tub 7 and the pulsator 9 herein.

An air trap 11 is installed to protrude toward an outward direction at a lower end of a lateral wall of the water tank 5. The air trap 11 is connected to a water level sensor 13, which is arranged at an upper side, through a hose 15. The water level sensor 13 may measure a water level in contiguity with the air trap 11 inside the water tank 5.

Also, a motor 17 (that is, a rotating device), a current detection sensor 17*a* as a detection device configured to detect a driving current of the motor 17 in the form a physical amount, a rotation sensor 18 configured to detect rotation of the motor 17, and a clutch mechanism 19 configured to be switchable between a first state in which a rotational force of the motor 17 is transmitted to both the rotating tub 7 and the pulsator 9 and a second state in which the rotational force of the motor 17 is transmitted only to the pulsator 9, may be arranged at a lower part of a bottom wall of the water tank 5. Therefore, the motor 17 and the clutch mechanism 19 may perform a first rotating operation in which the rotating tub 7 and the pulsator 9 are rotated together, and a second rotating operation in which the rotating tub 7 is fixed and only the pulsator 9 is rotated.

Also, a water supply case 20, which includes a water supply pipe 21, may be installed at a center part of an upper rear side of the water tank 5 (that is, in a horizontal direction in FIG. 1). One end of a first water supply pipe 23 is connected to the water supply pipe 21, and the other end thereof is connected to a water pipe (not shown).

A first water supply valve 25 is connected to the first water supply pipe 23, and, when the first water supply valve 25 is open, tap water flows into the rotating tub 7 through the water pipe and the first water supply pipe 23. Therefore, the water supply pipe 21 includes the first water supply pipe 23 and the first water supply valve 25 to configure a water supplier that supplies water inside the water tank 5.

Also, a detergent case 22 having a detergent inlet 22*a* may be arranged to be drawable from the water supply case 20.

A user may input detergent into the detergent case 22 using the detergent inlet 22*a*, and, when the first water supply valve 25 is open in a state in which the detergent case 22 is inserted into (that is, accommodated in) the water supply case 20, tap water containing the detergent flows out from the water supply pipe 21 toward the rotating tub 7.

Also, a spray nozzle 34 is installed at an upper back side of the water tank 5 to spray water toward a lateral wall of the rotating tub 7. One end of a second water supply pipe 24 is connected to the spray nozzle 34, and the other end thereof is connected to the water pipe (not shown).

A second water supply valve 26 is connected to the second water supply pipe 24, and, when the second water supply valve 26 is open, the tap water is sprayed from the spray nozzle 34 over a surface of laundry inside the rotating tub 7 by about 4 liters per minute (in on embodiment) through the water pipe and the second water supply pipe 24. Therefore, the second water supply pipe 24 includes the second water supply valve 26 and the spray nozzle 34 to configure a wetting device.

Also, an outlet 27 is formed at a bottom surface of the water tank 5 to enable the water accommodated inside the water tank 5 to flow out, a circulation pipe 29 configured to vertically extend is arranged outside of the water tank 5, and a lower end of the circulation pipe 29 is connected to the outlet 27.

Further, a shower nozzle 33 is mounted on an upper part of the circulation pipe 29 to face the lateral wall of the rotating tub 7, and a circulation pump 35 is installed in contiguity with the outlet 27 of the circulation pipe 29. When the circulation pump 35 is driven, the water accommodated in the water tank 5 is sprayed from the shower nozzle 33 over the surface of the laundry inside the rotating tub 7 via the outlet 27 and the circulation pipe 29. Therefore, the outlet 27, the circulation pipe 29, the shower nozzle 33, and the circulation pump 35 configure a circulation device.

Also, a drain 28 is formed at the bottom surface of the water tank 5 to enable the water accommodated inside the water tank 5 to flow out, and is connected to a drain pipe 37. A drain pump 36 is installed in contiguity with the drain 28. When the drain pump 36 is driven, the water accommodated in the water tank 5 flows out through the drain 28 and the drain pipe 37. Therefore, the drain 28, the drain pipe 37, and the drain pump 36 configure a drain device.

Also, an imbalance detection sensor 41 is mounted on the bottom surface of the water tank 5 as an abnormality detection device configured to detect unbalanced abnormality.

Further, a light source 42*a* and an optical sensor 42*b* detecting light from the light source 42*a* are arranged at an upper part of an inner surface of the rotating tub 7 to face each other by interposing the rotating tub 7.

Figure 3:
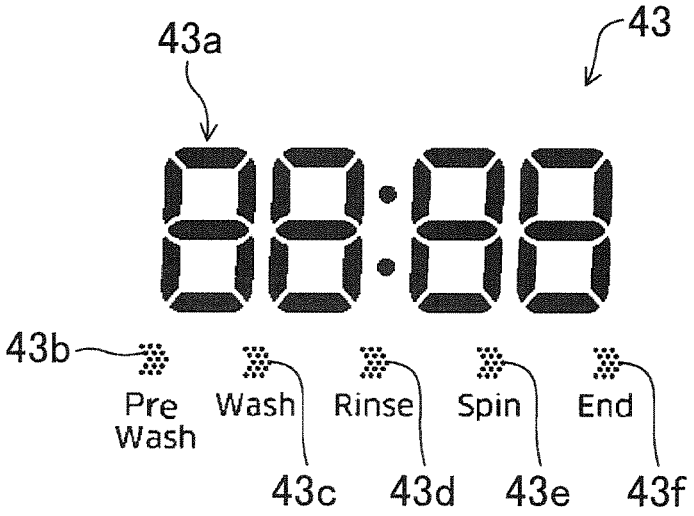
FIG. 3 is a diagram showing the appearance of the display.

In addition, as shown in FIGS. 1 and 3, a display 43 is installed at an upper part of the outer frame 3.

The display 43 is configured with, for example, a liquid crystal display, and is provided with a remaining time indicator 43*a* configured to display a remaining time until termination of the wash cycle and indicators 43*b* to 43*f* respectively configured to display first to fifth cycles. A controller 45 is arranged at a rear surface side of the display 43 to control each operation of the washing machine 1. A detailed operation of the controller 45 will be described below with reference to FIG. 4.

Figure 4:
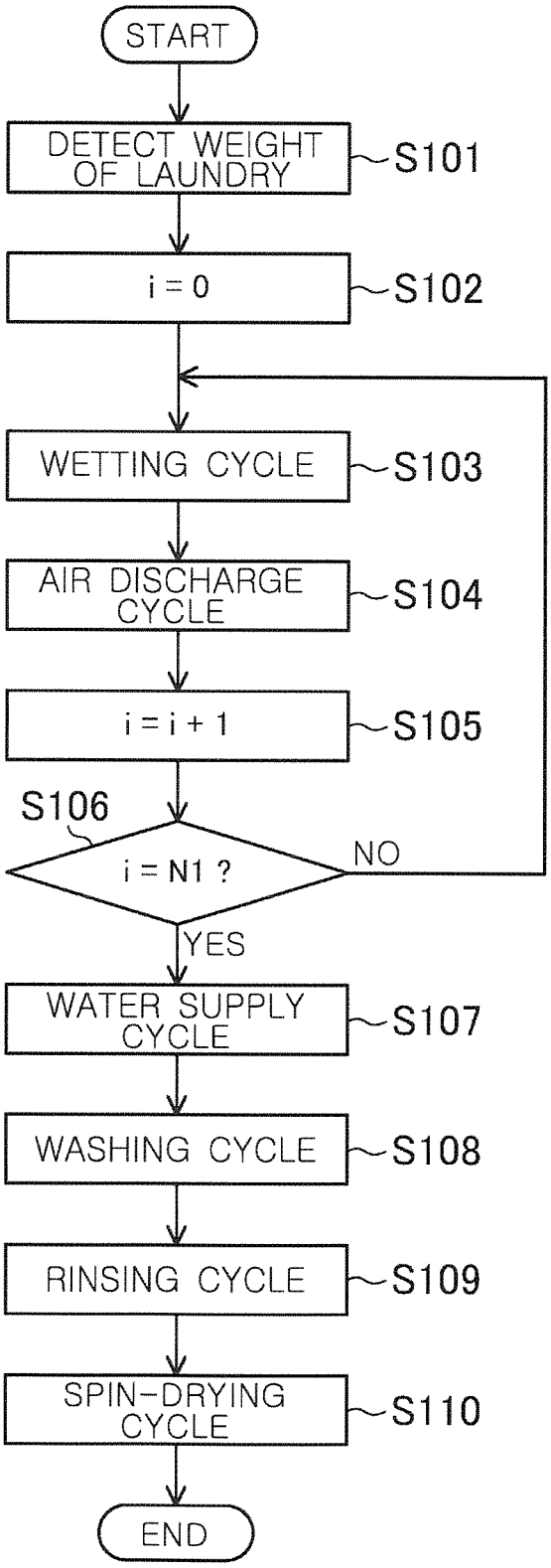
FIG. 4 is a flowchart showing the operation sequence of the washing machine with one embodiment of the present disclosure.

Next, an operation sequence of the washing machine 1 according to one embodiment of the present disclosure will be described with reference to FIG. 4.

When a user puts laundry into the rotating tub 7, puts detergent into the detergent case 22, inserts the detergent case 22 into the water supply case 20, and commences execution of the wash cycle, the controller 45 calculates a weight of the laundry in Operation (shown in the drawing as S) S101.

The weight of the laundry is determined by setting the clutch mechanism 19 to a first state on the basis of the number of rotation times which is detected at every unit time by the rotation sensor 18. Particularly, the controller 45 raises a speed from an initial value of 0 to a predetermined target value within a predetermined time to calculate the weight of the laundry on the basis of a current value detected by the current detection sensor 17*a*. Thereafter, the controller 45 proceeds to Operation S102.

In Operation S102, the controller 45 sets i=0 and then proceeds to Operation S103.

In Operation S103, the controller 45 executes a wetting cycle (that is, a second cycle) in which water is sprayed over a surface of the laundry accommodated in the rotating tub 7, and proceeds to Operation S104 to execute an air discharge cycle (that is, a first cycle) in which air contained inside the laundry in the rotating tub 7 is discharged.

Therefore, in the present disclosure, the first cycle refers to a cycle in which air contained inside the laundry is discharged, and the second cycle refers to a cycle in which the water is sprayed over the surface of the laundry to prevent air from penetrating inside the laundry. For convenience, these will be respectively described in a detailed description as an air discharge cycle and a wetting cycle.

In Operation S105, the controller 45 sets i=i+1 and then proceeds to Operation S106.

In Operation S106, the controller 45 determines whether i is equal to or greater than N1 (≥1), and then, when i is equal to or greater than N1, it proceeds to Operation S107, and otherwise, it returns to Operation S103.

In Operation S107, the controller 45 executes a water supply cycle by opening the first water supply valve 25 to supply the water to the water tank 5 up to a predetermined set level of water. The controller 45 determines whether a level of the water accommodated in the water tank 5 is equal to or greater than the predetermined set level of water at every predetermined time while the water is supplied on the basis of a measurement result of the water level sensor 13. When the level of the water accommodated in the water tank 5 is determined to be equal to or greater than the predetermined set level of water, the controller 45 closes the first water supply valve 25 to terminate a supply of water. Thereafter, the controller 45 proceeds to Operation S108.

In Operation S108, the controller 45 executes a wash cycle. The controller 45 drives the motor 17 for a predetermined time (that is, a first rotating operation) by setting the clutch mechanism 19 to the first state and at the same time drives the circulation pump 35. At this point, a driving current of the motor 17 is set to rotate the rotating tub 7 at 60 revolutions per minute (rpm), in one embodiment. Therefore, in this embodiment the rotating tub 7 is rotated together with the pulsator 9 at 60 rpm.

In such a case, the water accommodated in the water tank 5 is sprayed by the driving of the circulation pump 35 from the shower nozzle 33 over the surface of the laundry inside the rotating tub 7 via the outlet 27 and the circulation pipe 29. When a predetermined time passes after the motor 17 is driven, the controller 45 opens a drain valve 39 to enable the water to flow out. Thereafter, the controller 45 proceeds to Operation S109.

In Operation S109, the controller 45 controls the first water supply valve 25, the motor 17, and the clutch mechanism 19 to execute a rinsing cycle in which the washing machine 1 performs a rinsing operation. When the rinsing cycle is terminated, the controller 45 drives the drain pump 36 to enable the water to flow out.

In Operation S110, the controller 45 executes a spin-drying cycle in which the motor 17 is driven for a predetermined time (that is, the first rotating operation) and the rotating tub 7 is rotated together with the pulsator 9 by setting the clutch mechanism 19 to the first state, and then the washing operation of the washing machine 1 is terminated.

Figure 9:
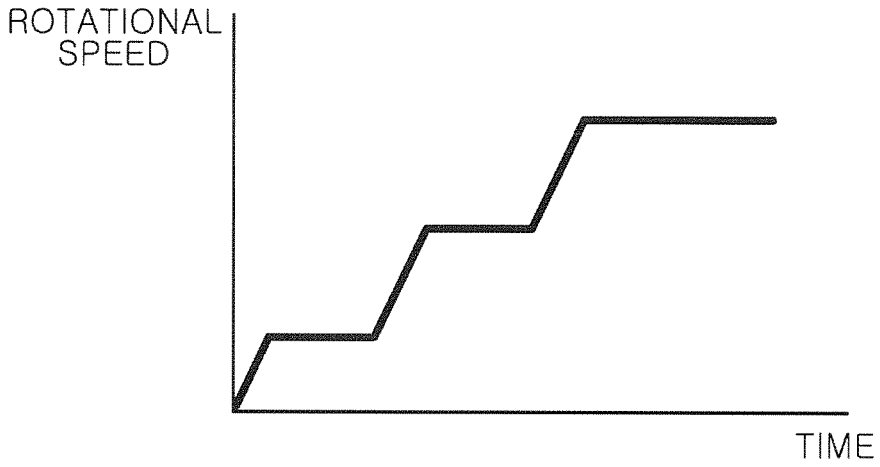
FIG. 9 is a graph showing the rotation speed of the rotary tub when the motor is started in the spin-drying cycle.

The driving current of the motor 17 in the spin-drying cycle is set to rotate the rotating tub 7 in the range of 900 to 1000 rpm. Also, in the spin-drying cycle, the driving current may be set to raise a rotational speed in a stepped shape as shown in FIG. 9 when the motor 17 is driven.

In addition, the controller 45 controls only the first cycle indicator 43*b* among the first to fifth cycle indicators 43*b* to 43*f* to emit light while the wetting cycle and the air discharge cycle are currently executed, and controls only the second cycle indicator 43*c* to emit light while the wash cycle is currently executed. Further, the controller 45 controls only the third cycle indicator 43*d* to emit light while the rinsing cycle is currently executed, only the fourth cycle indicator 43*e* to emit light while the spin-drying cycle is currently executed, and only the fifth cycle indicator 43*f* to emit light when the washing operation of the washing machine 1 is terminated.

Figure 5:
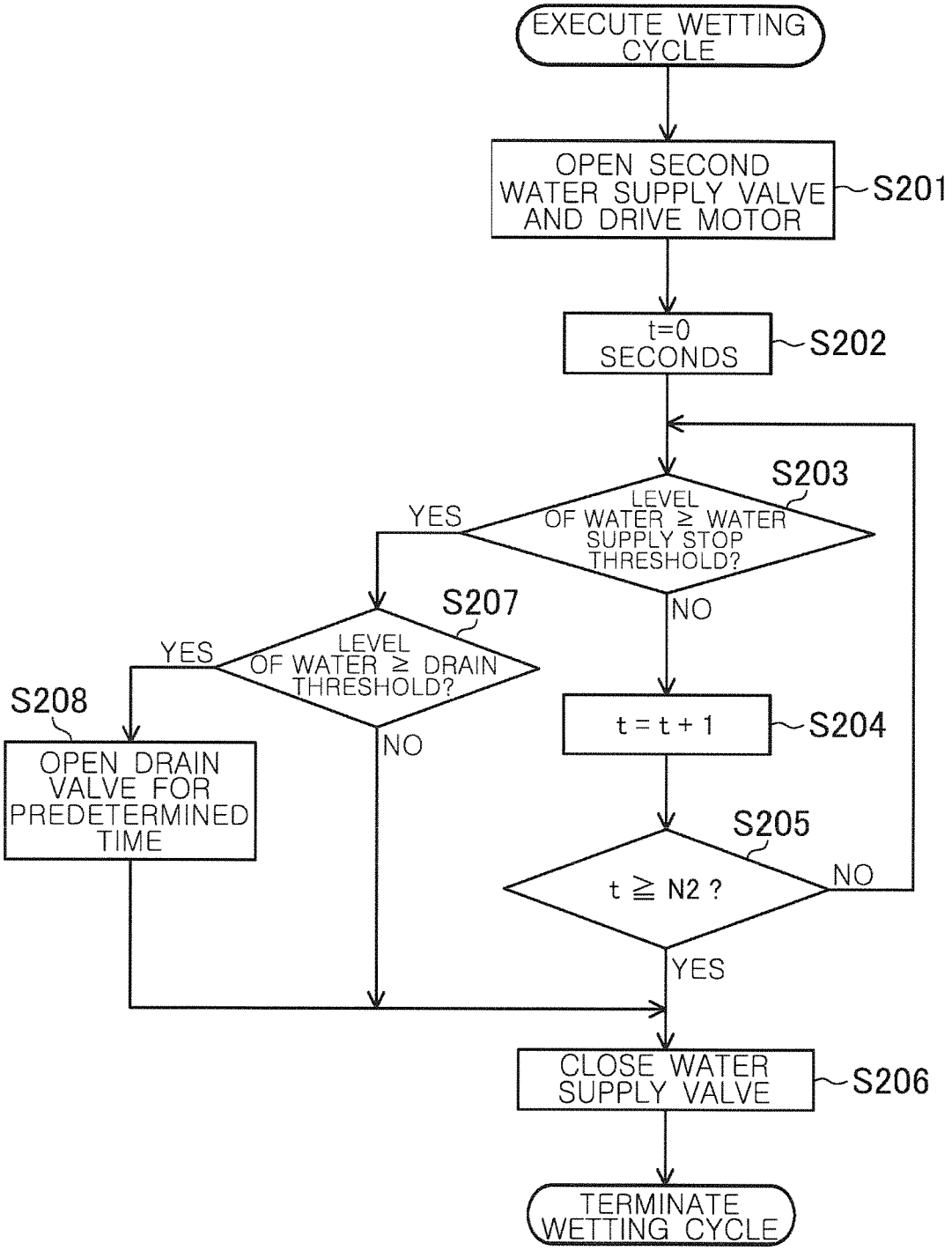
FIG. 5 is a flowchart showing the operation sequence of the washing machine in the wetting cycle in accordance with one embodiment of the present disclosure.

Next, the wetting cycle (that is, the second cycle) executed in Operation S103 will be described in detail with reference to FIG. 5.

First, in Operation S201, the controller 45 drives the motor 17 by setting the clutch mechanism 19 to the first state. As such, the rotating tub 7 is rotated together with the pulsator 9, and at this point, a rotational speed of each of the rotating tub 7 and the pulsator 9 is set to be equal to or less than 300 rpm, in one embodiment. For example, the rotational speed is set in the range of 20 to 60 rpm, in one embodiment.

Figure 7:
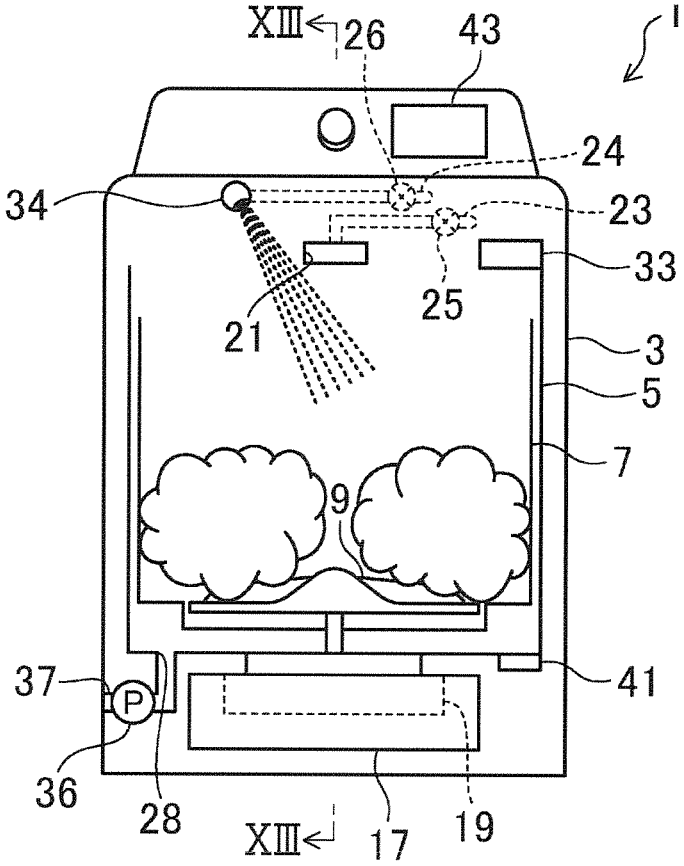
FIG. 7 is a diagram showing a state of a washing machine that performs the wetting cycle in accordance with one embodiment of the present disclosure.

Also, the controller 45 opens the second water supply valve 26. As shown in FIG. 7, the water is sprayed from the spray nozzle 34 over an upper part of the laundry inside the rotating tub 7 by about 4 liters per minute through the water pipe and the second water supply pipe 24. As described above, when the water is sprayed in a state in which the rotating tub 7 is rotated together with the pulsator 9, the sprayed water may be uniformly distributed on the laundry so that a washing effect may be improved. Thereafter, the controller 45 proceeds to Operation S202.

In Operation S202, the controller 45 sets t=0 and then proceeds to Operation S203.

In Operation S203, the controller 45 determines whether a level of the water in the water tank 5 is equal to or greater than a predetermined water supply stop threshold on the basis of a measurement result of the water level sensor 13.

When the level of the water in the water tank 5 is not equal to or greater than the predetermined water supply stop threshold, the controller 45 proceeds to Operation S204, and otherwise, it proceeds to Operation S207.

Further, the water supply stop threshold is set to be lower than the predetermined set level of water. For example, a level of the water in the wash cycle is set to prevent the water from flowing out from the water tank 5 when the rotating tub 7 is rotated at 500 rpm in the air discharge cycle, in one embodiment.

In Operation S204, the controller 45 sets t=t+1 and then proceeds to Operation S205.

In Operation S205, the controller 45 determines whether t is equal to or greater than a predetermined threshold value N2 (≥2), and then, when t is equal to or greater than the predetermined threshold value N2, it proceeds to Operation S206, and otherwise, it returns to Operation S203.

In Operation S206, the controller 45 closes the second water supply valve 26 to stop spraying of the water and to terminate the wetting cycle. Moreover, at this point, the motor 17 is not stopped and thus the rotating tub 7 is continuously rotated.

In Operation S207, the controller 45 determines whether the level of the water in the water tank 5 is equal to or greater than a predetermined drain threshold on the basis of the measurement result of the water level sensor 13. Here, the predetermined drain threshold is set to be higher than the predetermined water supply stop threshold.

When the level of the water in the water tank 5 is not equal to or greater than the predetermined drain threshold, the controller 45 proceeds to Operation S206, and otherwise, it proceeds to Operation S208.

In Operation S208, the controller 45 closes the second water supply valve 26 to stop a supply of the water, drives the drain pump 36 for a predetermined time to enable the water to flow out, and then proceeds to Operation S206.

Also, in Embodiment 1 of the present disclosure, the determination is performed in both Operations S203 and S207, but alternatively, it may be performed only in Operation S203 or S207.

Figure 6:
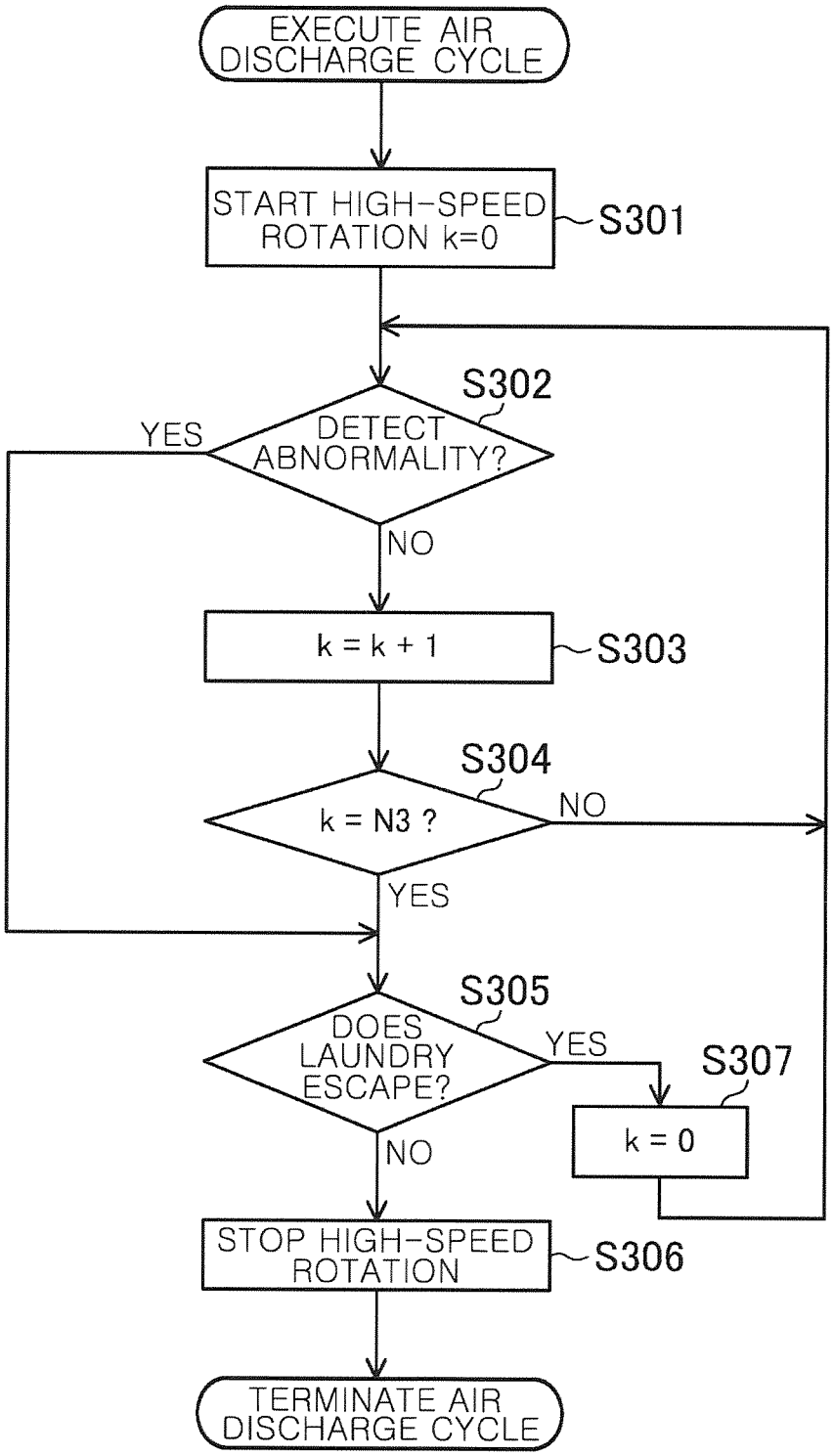
FIG. 6 is a flowchart showing the operation sequence of the washing machine in the air discharge cycle in accordance with one embodiment of the present disclosure.

Next, the air discharge cycle (that is, the first cycle) executed in Operation S104 will be described in detail with reference to FIG. 6.

First, in Operation S301, the controller 45 controls the driving current of the motor 17 by setting the clutch mechanism 19 to the first state to raise the rotational speed of the rotating tub 7 from a value in the wetting cycle to 500 rpm (that is, the first rotating operation), in one embodiment.

Figure 8:
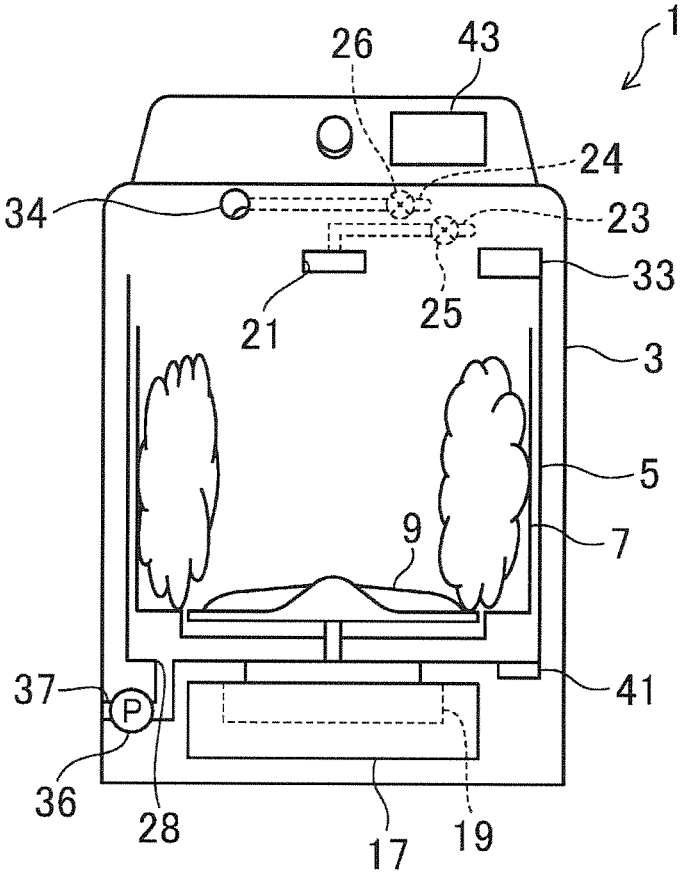
FIG. 8 is a diagram showing a state of a washing machine that performs the air discharge cycle in accordance with one embodiment of the present disclosure.

In this example, the rotating tub 7 is rotated together with the pulsator 9 at a rotational speed of 500 rpm so that the laundry is adhered to an inner circumferential surface of the rotating tub 7 as shown in FIG. 8, and thus air contained inside the laundry is discharged by a centrifugal force.

When the laundry is a feather product, it begins to be compressed when the rotational speed of the rotating tub 7 reaches about 150 rpm and then the air contained inside the laundry begins to be discharged. Also, the controller 45 sets k=0 seconds. Further, when the rotating tub 7 begins to be rotated, the controller 45 proceeds to Operation S302.

As such, since the rotating tub 7 is not stopped between the wetting cycle and the air discharge cycle, a time required for stopping the rotating tub 7, a time required for verifying a stoppage of the rotating tub 7, and a time required for commencing rotation of the rotating tub 7 are not necessary such that a washing time may be reduced. Further, there is no need to re-drive the motor 17 so that power consumption may be reduced.

In Operation S302, the controller 45 determines whether an imbalance is currently detected by the imbalance detection sensor 41. When the imbalance is not detected, the controller 45 proceeds to Operation S303, and otherwise, it proceeds to Operation S305.

In Operation S303, the controller 45 sets k=k+1 seconds and then proceeds to Operation S304.

In Operation S304, the controller 45 determines whether k is equal to or greater than a predetermined time threshold value N3 (≥2), and then, when k is equal to or greater than N3, it proceeds to Operation S305, and otherwise, it returns to Operation S302.

Figure 10:
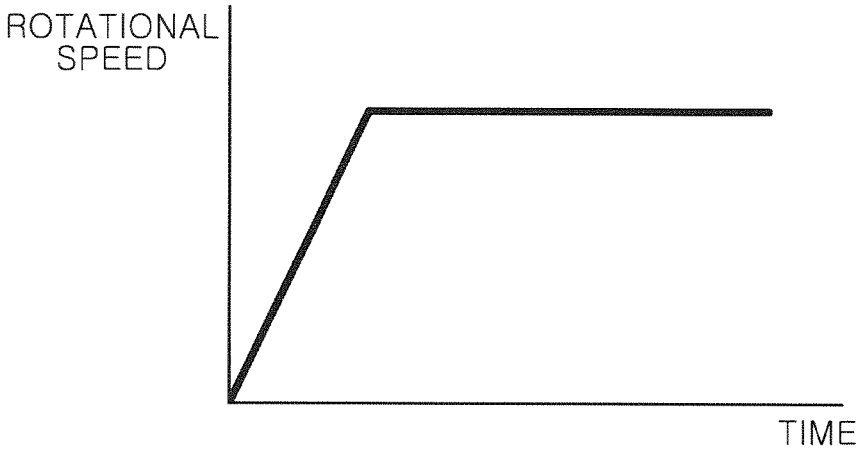
FIG. 10 is a graph showing the rotation speed of the rotary tub when the motor is started in the air discharge cycle.

Also, since an amount of the water contained inside the laundry is small in the air discharge cycle, the rotational speed of the motor 17 may be rapidly raised in comparison with that of the motor 17 in the spin-drying cycle as shown in FIG. 10.

Further, it is preferable to raise the rotational speed of the rotating tub 7 in the range of 300 to 500 rpm, in some embodiments. The reason for that is that the air contained inside the laundry is not sufficiently discharged when the rotational speed is below 300 rpm and the laundry is a feather product, and a time required for executing the air discharge cycle is longer when the rotational speed is over 500 rpm to increase a washing time, in some embodiments.

In Operation S305, the controller 45 controls the light source 42*a* to emit light and determines that the laundry is escaped from the rotating tub 7 when the light is detected by the optical sensor 42*b* to proceed to Operation S306, and otherwise, it proceeds to Operation S307.

In Operation S306, the controller 45 controls the driving current of the motor 17 to stop the rotation of the rotating tub 7. Thereafter, the air discharge cycle is terminated.

In Operation S307, the controller 45 sets k=0 seconds and then returns to Operation S302.

Also, in Embodiment 1 of the present disclosure, a termination time of the air discharge cycle is controlled on the basis of an elapsed time of the motor 17, but alternatively, it may be controlled on the basis of other conditions in addition to the elapsed time.

Therefore, in accordance with Embodiment 1 of the present disclosure, the rotational speed of the rotating tub 7 (for example, 500 rpm) in the air discharge cycle is higher than that of the rotating tub 7 (for example, 60 rpm) in the wash cycle and thus the laundry may be compressed and adhered to the inner lateral surface of the rotating tub 7 even when the laundry is a feather product such that the air contained inside the laundry may be effectively discharged. Consequently, the laundry may be prevented from floating to a surface of water when being washed so that cleaning power may be increased.

Particularly, when the laundry is arranged in a ring shape at an outer circumferential portion of a bottom part of the rotating tub 7 when being input to the rotating tub 7, it may be more uniformly compressed in the air discharge cycle so that an effect of improving cleaning power may be increased. Also, in such a case, it may be difficult to detect an imbalance so that a high-speed rotation of the rotating tub 7 may be more reliably performed in the air discharge cycle for a predetermined time corresponding to N3.

Further, even when the laundry is the feather product, a gap between yarns of a high density woven surface fabric may be blocked by the water through the wetting cycle so that the laundry may be prevented from floating resulting from a penetration of air into the laundry after the air discharge cycle.

Particularly, when the laundry is arranged in the ring shape at the outer circumferential portion of the bottom part of the rotating tub 7 when being input to the rotating tub 7, the water may be uniformly sprayed over the surface of the laundry so that floating of the laundry may be effectively prevented.

Also, the controller 45 executes the wetting cycle before the water supply cycle is terminated and thus the air is prevented from penetrating into the laundry after the water supply cycle is terminated so that the floating of the laundry may be prevented.

Further, in the wetting cycle, the rotational speed of the rotating tub 7 is set to 300 rpm or less so that the water may be prevented from splashing to the outside compared to that the rotational speed of the rotating tub 7 is set over 300 rpm.

Moreover, since the water supply stop threshold and the drain threshold are set, a water leak may be prevented in the air discharge cycle.

Additionally, in the wash cycle, the water is sprayed from an upper side of the laundry and at the same time the rotating tub 7 is rotated so that cleaning power is increased in comparison with a case in which only the rotating tub 7 is rotated without spraying of the water over the laundry.

Also, in Embodiment 1 of the present disclosure, the wetting cycle and the air discharge cycle are alternately repetitively performed so that the air contained inside the laundry may be effectively discharged.

In addition, the display 43 differently displays thereon other cycles except for the wetting cycle and the air discharge cycle so that a user may easily distinguish a cycle being currently executed through only recognition of the display 43.

Further, in Embodiment 1 of the present disclosure, there is disclosed a display method of controlling any one of the first to fifth cycle indicators 43*b* to 43*f* to emit light, but it is not limited thereto, and the display method may include any method capable of enabling the user to distinguish a cycle being currently executed.

Moreover, in Operation S305 of Embodiment 1 of the present disclosure, even when the light from the light source 42*a* is blocked by laundry escaped from the rotating tub 7 and thus is not detected by the optical sensor 42*b*, a high-speed rotation of the rotating tub 7 is still performed so that the escaped laundry may be likely to be drawn again into the rotating tub 7 by the high-speed rotation thereof. Consequently, floating of the escaped laundry may be prevented and further the escaped laundry may be washed with an improved cleaning power.

Embodiment 2

Figure 11:
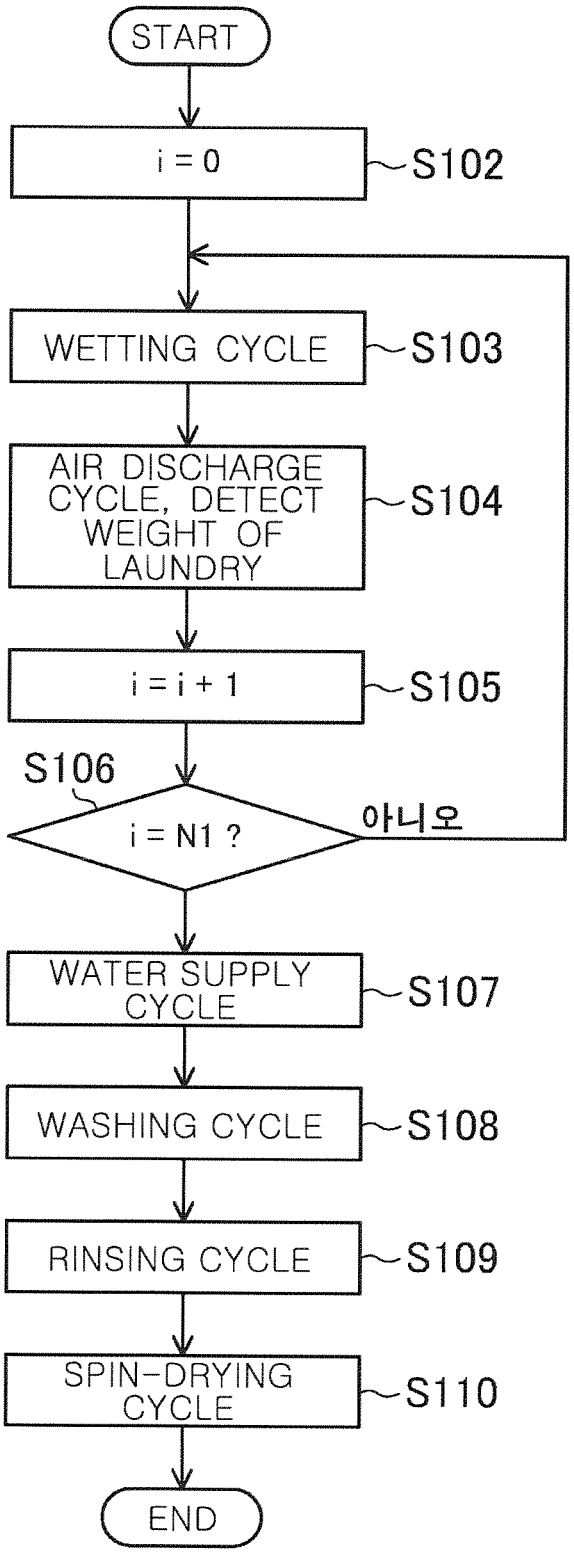
FIG. 11 is a flowchart illustrating an operation of the washing machine 1 according to Embodiment 2 of the present disclosure.

FIG. 11 is a flowchart illustrating an operation of the washing machine 1 according to Embodiment 2 of the present disclosure.

In Embodiment 2 of the present disclosure, after a user inputs the commencement of washing, Operation S101 is not executed and a weight of laundry is calculated in Operation S301 in which an air discharge cycle is executed.

Particularly, the controller 45 controls a driving current of the motor 17 to raise the number of rotation times per unit time (that is, a rotational speed of the rotating tub 7), which is detected by the rotation sensor 18, from an initial value (≥ a value corresponding to a rotational speed in a wetting cycle) to a target value (≤ a value corresponding to 500 rpm, in one example) within a predetermined time, and then calculates the weight of the laundry on the basis of a current value detected by the current detection sensor 17*a*.

Other configurations and operations of the washing machine 1 except for the above-mentioned descriptions are the same as those of Embodiment 1 of the present disclosure so that the same reference number is assigned to the same configuration and a detailed description thereof will be omitted.

Therefore, in accordance with Embodiment 2 of the present disclosure, since the controller 45 may calculate the weight of the laundry on the basis of the driving current of the motor 17 detected upon a rotating operation in the air discharge cycle, it may not need to perform a separate rotating operation so as to calculate the weight of the laundry so that a time required for washing may be reduced.

Embodiment 3

Figure 12:
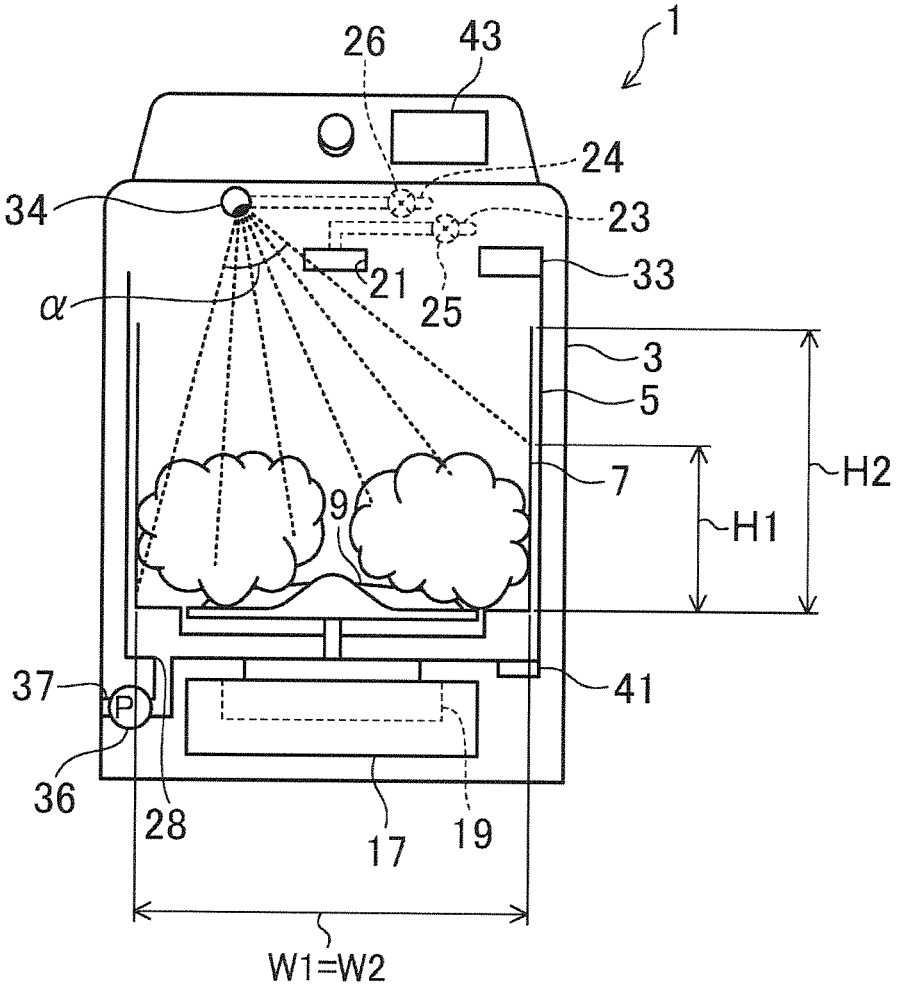
FIG. 12 is a diagram illustrating the washing machine 1 according to Embodiment 3 of the present disclosure.

FIG. 12 is a diagram illustrating the washing machine 1 according to Embodiment 3 of the present disclosure.

In Embodiment 3 of the present disclosure, a spray angle α of the spray nozzle 34 in a horizontal direction is set to 48 degrees, and a spray width W1 of water, which is sprayed from the spray nozzle 34 over the bottom surface of the rotating tub 7, in the horizontal direction is set as the same as a width W2 of the bottom surface of the rotating tub 7.

Also, a portion of the water, which is sprayed from the spray nozzle 34, is sprayed toward the lateral surface of the rotating tub 7, and a spray width H1 of the water, which is sprayed toward the lateral surface of the rotating tub 7, in a vertical direction is set to about 60% (in one example) with respect to a width H2 of the lateral surface of the rotating tub 7 in the vertical direction.

Other configurations and operations of the washing machine 1 except for the above-mentioned descriptions are the same as those of Embodiment 1 of the present disclosure so that the same reference number is assigned to the same configuration and a detailed description thereof will be omitted.

Therefore, in accordance with Embodiment 3 of the present disclosure, a sum of the spray width W1 of the water, which is sprayed over the bottom surface of the rotating tub 7, in the horizontal direction, and the spray width H1 of the water, which is sprayed toward the lateral surface of the rotating tub 7, in the vertical direction is set to be equal to or greater than ⅓ of the width W2 of the bottom surface of the rotating tub 7 so that the water may be more widely sprayed over the surface of the laundry compared to that the sum is set to be less than ⅓ of the width W2 of the bottom surface of the rotating tub 7, in one example. Consequently, an amount of the tap water required for the wetting cycle may be reduced.

Embodiment 4

Figure 13:
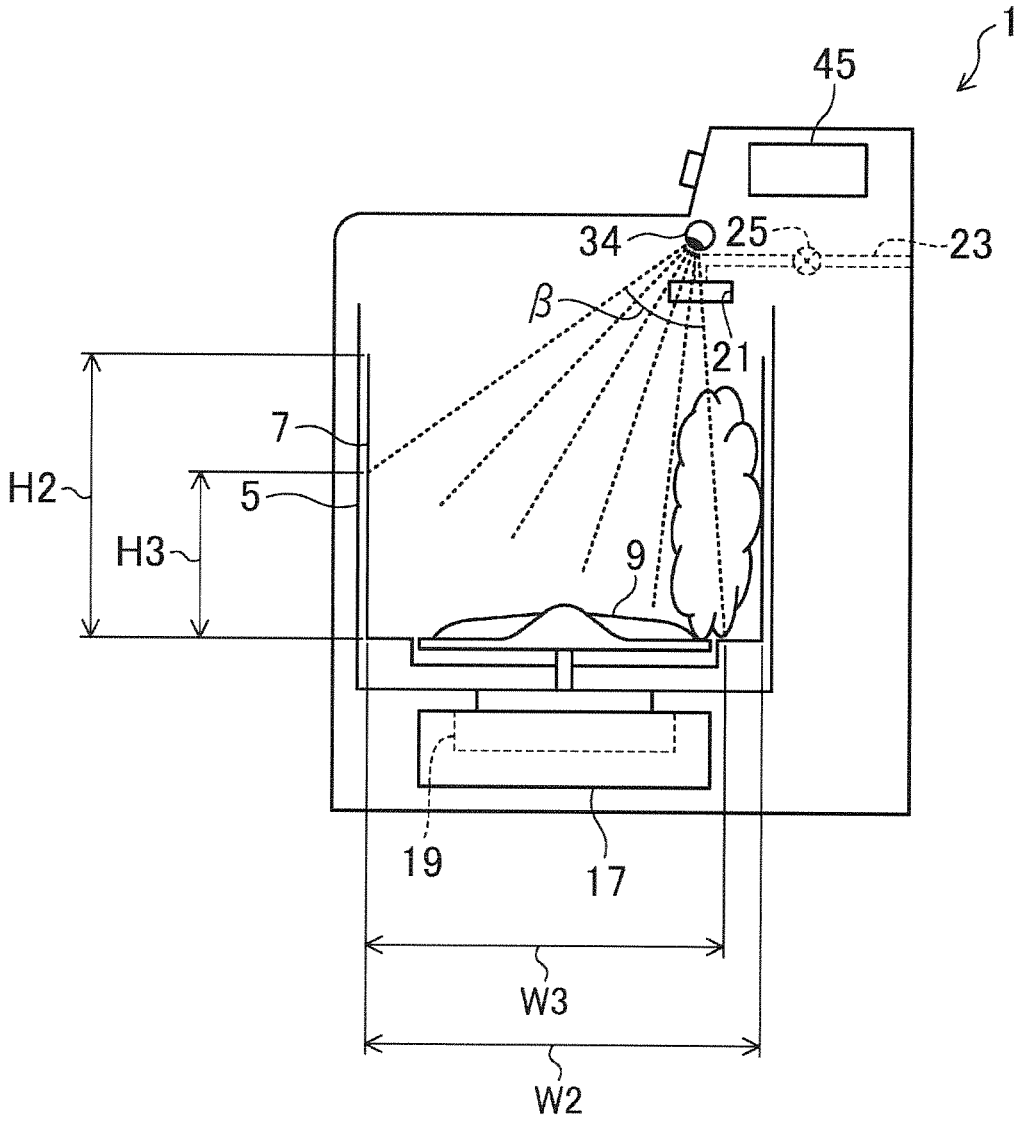
FIG. 13 is a diagram illustrating the washing machine 1 according to Embodiment 4 of the present disclosure.

FIG. 13 is a diagram illustrating the washing machine 1 according to Embodiment 4 of the present disclosure.

In Embodiment 4 of the present disclosure, a spray angle β of the spray nozzle 34 in forward and backward directions is set to 44 degrees, and a spray width W3 of water, which is sprayed from the spray nozzle 34 over the bottom surface of the rotating tub 7, in the forward and backward directions is set to 90% (in one embodiment) of the width W2 of the bottom surface of the rotating tub 7.

Also, a portion of the water, which is sprayed from the spray nozzle 34, is sprayed toward the lateral surface of the rotating tub 7, and a spray width H3 of the water, which is sprayed toward the lateral surface of the rotating tub 7, in the vertical direction is set to about 60% (in one example) of a width H2 of the lateral surface of the rotating tub 7 in the vertical direction.

Other configurations and operations of the washing machine 1 except for the above-mentioned descriptions are the same as those of Embodiment 1 of the present disclosure so that the same reference number is assigned to the same configuration and a detailed description thereof will be omitted.

Therefore, in accordance with Embodiment 4 of the present disclosure, a sum of the spray width W3 of the water, which is sprayed over the bottom surface of the rotating tub 7, in the forward and backward directions, and the spray width H3 of the water, which is sprayed toward the lateral surface of the rotating tub 7, in the vertical direction is set to be equal to or greater than ⅓ of the width W2 of the bottom surface of the rotating tub 7 so that the water may be more widely sprayed over the surface of the laundry compared to that the sum is set to be less than ⅓ of the width W2 of the bottom surface of the rotating tub 7, in one example. Consequently, an amount of the tap water required for the wetting cycle may be reduced.

Embodiment 5

Figure 14:
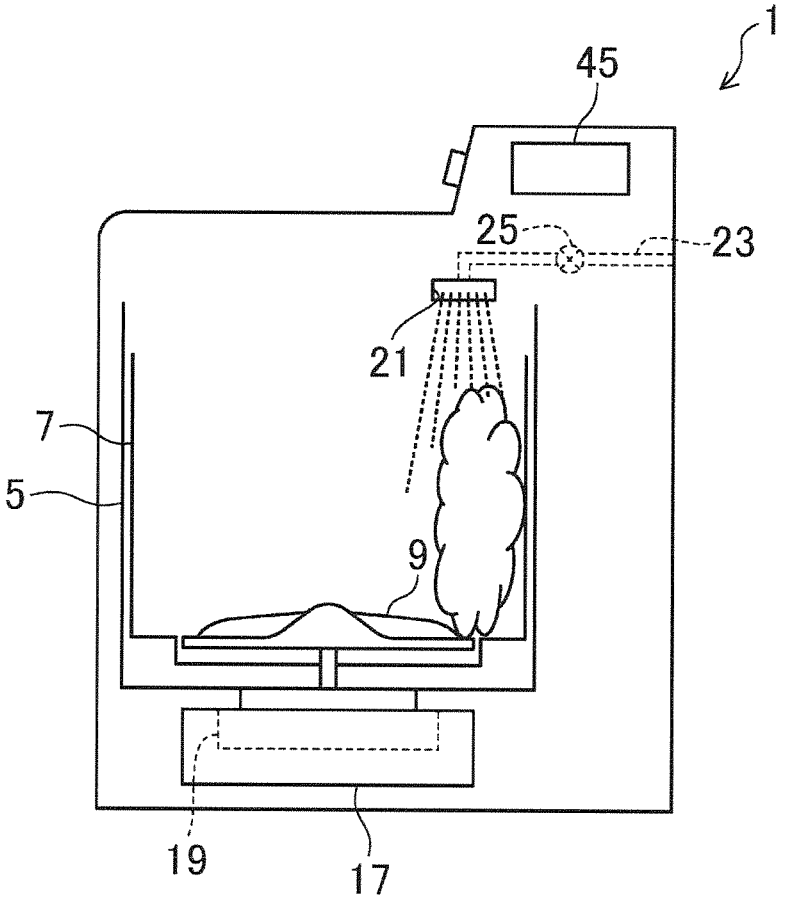
FIG. 14 is a diagram illustrating the washing machine 1 according to Embodiment 5 of the present disclosure.

FIG. 14 is a diagram illustrating the washing machine 1 according to Embodiment 5 of the present disclosure.

In Embodiment 5 of the present disclosure, the water supply pipe 21 is formed at an end of the upper side of the water tank 5 in the horizontal direction such that water may be sprayed toward an inner lateral surface of the rotating tub 7. Further, the first water supply valve 25 is open instead of the second water supply valve 26 in Operation S201 of the wetting cycle, and the second water supply valve 26 is closed in Operations S206 and S208 of the wetting cycle so that the water may be sprayed over a surface of laundry adhered to the inner lateral surface of the rotating tub 7. That is, in Embodiment 5 of the present disclosure, a water supplier configured with the water supply pipe 21, the first water supply pipe 23, and the first water supply valve 25 is also used as the wetting device.

Other configurations and operations of the washing machine 1 except for the above-mentioned descriptions are the same as those of Embodiment 1 of the present disclosure so that the same reference number is assigned to the same configuration and a detailed description thereof will be omitted.

Therefore, in accordance with Embodiment 5 of the present disclosure, there is no need to separately provide the wetting device so that a structure of the washing machine 1 is simplified. Consequently, the number of components and the number of assembly cycles may be decreased to reduce manufacturing costs. Further, in the water supply cycle, the water flowing from the water supply pipe 21 is directly sprayed over the laundry adhered to the inner lateral surface of the rotating tub 7 so that the laundry is prevented from floating due to penetration of air into the laundry after the commencement of a water supply.

Embodiment 6

Figure 15:
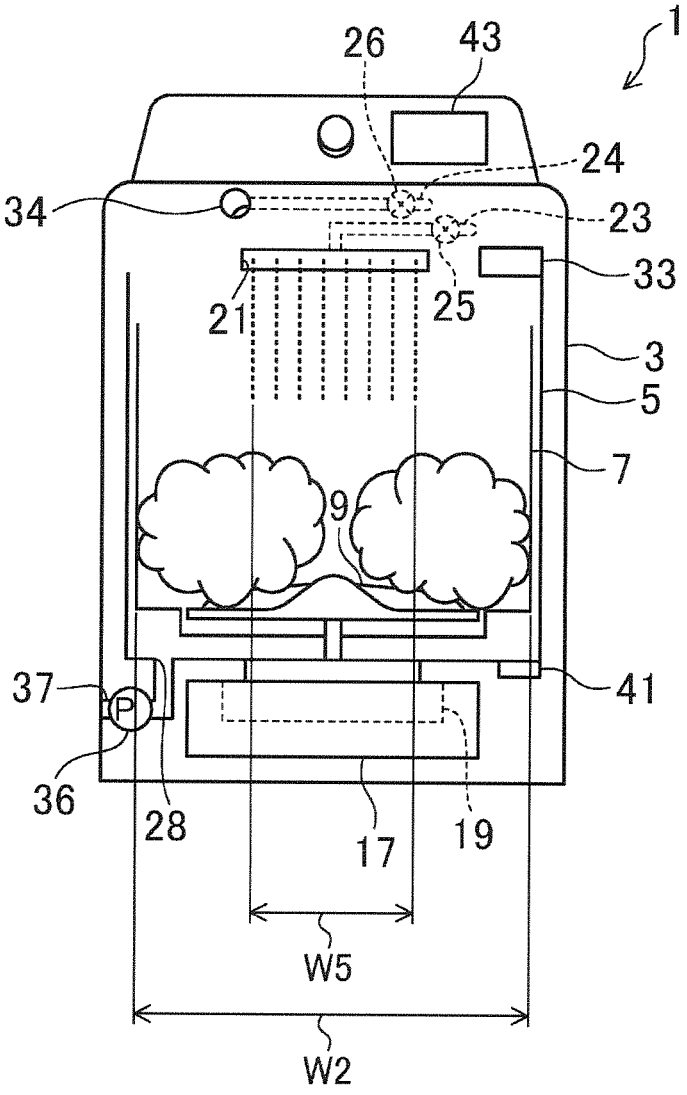
FIG. 15 is a diagram illustrating the washing machine 1 according to Embodiment 6 of the present disclosure.

FIG. 15 is a diagram illustrating the washing machine 1 according to Embodiment 6 of the present disclosure.

In Embodiment 6 of the present disclosure, it is configured such that water is sprayed in a horizontal direction of the water supply pipe 21, a spray angle of the water supply pipe 21 in the horizontal direction is set to 0 degrees, and a spray width W5 of the water, which is sprayed over the bottom surface of the rotating tub 7, in the horizontal direction is set to about 40% (in one example) of the width W2 of the bottom surface of the rotating tub 7.

Other configurations and operations of the washing machine 1 except for the above-mentioned descriptions are the same as those of Embodiment 5 of the present disclosure so that the same reference number is assigned to the same configuration and a detailed description thereof will be omitted.

Therefore, in accordance with Embodiment 6 of the present disclosure, the spray width W5 of the water, which is sprayed over the bottom surface of the rotating tub 7, in the horizontal direction is set to be equal to or greater than ⅓ of the width W2 of the bottom surface of the rotating tub 7 so that the water may be more widely sprayed over the surface of the laundry compared to that the spray width W5 is set to be less than ⅓ of the width W2 of the bottom surface of the rotating tub 7, in one example. Consequently, tap water may be effectively uniformly distributed on the laundry so that an amount of the tap water required for the wetting cycle may be reduced.

Also, in Embodiments 1 to 6 of the present disclosure, the clutch mechanism 19 is set to the first state in the wash cycle, but alternatively, it may be switched to a second state to eliminate contamination of the laundry by rotation of the pulsator 9.

Further, in Embodiments 1 to 6 of the present disclosure, it has been described that the water accommodated in the water tank 5 is sprayed from an upper side of the laundry by the driving of the circulation pump 35, but alternatively, the water may be sprayed over the laundry by raising a surface of the water through rotation of the rotating tub 7 in a state in which the water is accommodated in the water tank 5.

In such a case, the rotating tub 7, the motor 17, and the clutch mechanism 19 configure the circulation device, and in the wash cycle, the controller 45 controls the motor 17 and the clutch mechanism 19 instead of the circulation pump 35.

Additionally, in Embodiments 1 to 6 of the present disclosure, the air discharge cycle is executed before the water supply cycle is executed, but alternatively, it may be executed after the water supply cycle is executed in case that the water supply cycle is not terminated.

Further, in Embodiments 1 to 6 of the present disclosure, the wetting cycle is executed before the air discharge cycle is terminated, but alternatively, it may be executed at a different time in case that the water supply cycle is not terminated.

For example, the wetting cycle may be executed between the air discharge cycle and the water supply cycle. In such a case, when the air discharge cycle is terminated, the controller 45 may drop a rotational speed of the rotating tub 7 from a value in the air discharge cycle to a value in the wetting cycle in Operation S201 at the execution of the wetting cycle without stopping the rotation of the rotating tub 7 in Operation S305.

Alternatively, the wetting cycle may be simultaneously executed with the air discharge cycle. When the wetting cycle is simultaneously executed with the air discharge cycle, the controller 45 controls only the first cycle indicator 43*b* among the first to fifth cycle indicators 43*b* to 43*f* to emit light so that a user may easily distinguish whether cycles being currently executed are both the wetting cycle and the air discharge cycle, or are other cycles except for the wetting cycle and the air discharge cycle.

Also, in Embodiments 1 to 6 of the present disclosure, the rotation of the rotating tub 7 is stopped in Operation S305 when the air discharge cycle is terminated, but alternatively, the rotational speed of the rotating tub 7 may be dropped from the value in the air discharge cycle to 60 rpm (in one example) in parallel with the water supply cycle in Operation S107 without the stopping of the rotating tub 7. Consequently, a time required for the wash cycle may be reduced. Further, since the rotating tub 7 is rotated while the water is supplied and thus the water being supplied is uniformly sprayed over the laundry, the floating of the laundry is more reliably prevented.

Also, in Embodiments 1 to 4 of the present disclosure, the second water supply valve 26 is open in the wetting cycle so that the water being supplied may be sprayed from the spray nozzle 34 over the surface of the laundry inside the rotating tub 7.

Alternatively, before the wetting cycle is executed, the controller 45 may open the first water supply valve 25, execute the water supply cycle, and then drive the circulation pump 35 so that the water may be sprayed over an upper side of the surface of the laundry through the circulation pipe 29 and the shower nozzle 33.

As a result, the detergent is contained in the water supplied to the water tank 5 in the water supply cycle so that the water containing the detergent may be sprayed over the surface of the laundry in the wetting cycle. Therefore, even when the surface of the laundry is configured with a high density woven water repellent cloth, the detergent containing a surfactant is used so that the water may sufficiently penetrate the laundry. Consequently, air may be prevented from penetrating inside the laundry after the air discharge cycle. In such a case, the outlet 27, the circulation pipe 29, the shower nozzle 33, and the circulation pump 35 may configure the wetting device, and the controller 45 may control the circulation pump 35 to execute the wetting cycle.

Even in such a case, while the water supply cycle is executed, the controller 45 may perform a water supply stop control of closing the first water supply valve 25 when a level of water detected by the water level sensor 13 is equal to or greater than the predetermined water supply stop threshold, and a drain control of driving the drain pump 36 when the level of water detected by the water level sensor 13 is equal to or greater than the predetermined drain threshold.

Alternatively, the controller 45 may perform only one of the water supply stop control and the drain control.

Also, in Embodiments 1 to 4 of the present disclosure, while the wetting cycle is executed, the first water supply valve 25 may be temporarily open so that the water containing the detergent may be supplied from the water supply pipe 21 inside the rotating tub 7. Consequently, even when the surface of the laundry is configured with the high density woven water repellent cloth, the detergent containing the surfactant is used so that the water may sufficiently penetrate the laundry.

Alternatively, in Embodiments 1 to 4 of the present disclosure, the detergent may be contained in the water sprayed from the spray nozzle 34.

Further alternatively, in Embodiments 1 to 6 of the present disclosure, without installation of the detergent case 22, a user may directly sprinkle the detergent over the laundry inside the rotating tub 7 and then commence the wash cycle. Consequently, since the detergent dissolves in the water sprayed in the wetting cycle, even when the surface of the laundry is configured with the high density woven water repellent cloth, the detergent containing the surfactant is used so that the water may sufficiently penetrate the laundry.

Also, in the wetting cycle, a surface of the water between the rotating tub 7 and the lateral surface of the water tank 5 may be raised to enable the water to be sprayed over the surface of the laundry. In such a case, the rotating tub 7, the motor 17, and the clutch mechanism 19 configure the wetting device, and the controller 45 controls the motor 17 and the clutch mechanism 19 so that the wetting cycle may be executed.

Further, in Embodiments 1 to 6 of the present disclosure, the controller 45 drives the motor 17 in the first rotating operation, but alternatively, it may control the motor 17 to perform alternately repetitively the first and second rotating operations. In such a case, comparing to that the motor 17 is driven in the first rotating operation, the laundry adhered to the inner lateral surface of the rotating tub 7 may be easily separated therefrom in the air discharge cycle so that the cleaning power may be improved.

Also, in Embodiments 1 to 6 of the present disclosure, the second rotating operation has been described that the pulsator 9 is rotated in a state in which the rotating tub 7 is fixed, but alternatively, the pulsator 9 may be rotated relative only to the rotating tub 7. For example, the rotating tub 7 and the pulsator 9 may be rotated in opposite directions.

Further, in Embodiments 1 to 6 of the present disclosure, the diameter of the rotating tub 7 is set to 650 mm and the depth thereof is set to 500 mm (in one example), but alternatively, a dimension of the rotating tub 7 may be configured different from the above diameter and depth. For example, the diameter of the rotating tub 7 may be configured at 450 mm and the depth thereof may be configured at 395 mm, in one embodiment.

When a relative centrifugal force is RFC, an acceleration of gravity is g, a radius of rotation is r, and a rotational speed of the rotating tub 7 is N, a centrifugal force applied to the laundry in the air discharge cycle is calculated by the following equation.

$$RFC \times g = 2 \times \pi \times r \times N2/60 \quad \text{[Equation 1]}$$

Therefore, as described above for one embodiment, when the diameter of the rotating tub 7 is set to 450 mm and the depth thereof is set to 500 mm, that is, the diameter is set to be about 0.7 times that in Embodiments 1 to 6 of the present disclosure, a rotational speed is set to be about 1.2 times the rotational speed of the rotating tub 7 such that a relative centrifugal force that is approximately the same as that in Embodiments 1 to 6 of the present disclosure may be obtained. In this case, it is preferable to raise the rotational speed up to in the range of 360 to 600 rpm in the air discharge cycle, in one example.

Further, in Embodiments 1 to 6 of the present disclosure, when detecting an imbalance in the air discharge cycle, the controller 45 stops the motor 17 in Operation 305, but alternatively, the user may be informed of the imbalance through an alarming device, Operation S301 may be executed again, an imbalance correction cycle may be executed under the control of the motor 17 and the clutch mechanism 19, or the controller 45 may execute again from Operation S101.

Also, Embodiments 1 to 6 of the present disclosure may be applicable to the washing machine 1 having a configuration in which the water is accommodated only in the rotating tub 7.

Further, in Operation S302 of Embodiments 1 to 6 of the present disclosure, a bubble detection device configured to detect an amount of bubbles inside the rotating tub 7 may be installed inside the washing machine 1 so that the controller 45 may determine whether an excessive amount of bubbles is detected by the bubble detection device. Moreover, others in addition to the imbalance and the excessive amount of bubbles may be employed as an object to be detected.

Also, in Embodiments 1 to 6 of the present disclosure, both the rotating tub 7 and the pulsator 9 are rotated in Operation S201, but alternatively, only one of them may be rotated.

Additionally, in Embodiments 1 and 3 to 6 of the present disclosure, the spray time N2 of the water is not varied in the wetting cycle, but alternatively, it may be set to a first value when the weight of the laundry, which is calculated in Operation S101, is equal to or greater than a predetermined threshold value, and to a second value less than the first value when the weight of the laundry, which is calculated in Operation S101, is less than the predetermined threshold value.

In such a case, when the weight of the laundry is less than the predetermined threshold value, the spray time N2 of the water is shortened in the wetting cycle so that consumption of the water and electric power may be reduced and a time required for washing may be shortened.

Also, in Embodiments 1 and 3 to 6 of the present disclosure, the rotational speed of the rotating tub 7 is set to 500 rpm in the air discharge cycle, but alternatively, it may be set on the basis of the weight of the laundry calculated in Operation S101 and also may be set according to a detected kind of the laundry in addition to the weight, in one example.

Further, in Embodiments 1 to 6 of the present disclosure, the weight of the laundry is calculated on the basis of the current value detected by the current detection sensor 17*a* when the rotational speed of the rotating tub 7 is raised from the predetermined initial value to the predetermined target value within a predetermined time, but alternatively, it may be calculated on the basis of a current value detected by the current detection sensor 17*a* when the rotational speed of the rotating tub 7 is dropped from a predetermined initial value to a predetermined target value within a predetermined time.

Alternatively, when a predetermined driving current is applied to the motor 17, the weight of the laundry may be calculated on the basis of other physical amounts, which are detected by other detection devices in the air discharge cycle, including a time in which the number of rotation times (that is, a rotational speed), which is detected by the rotation sensor 18 for a predetermined unit time, reaches from a predetermined initial value to a predetermined target value, and the like.

Further, in Embodiments 1 to 6 of the present disclosure, when the laundry is escaped from an opening of the rotating tub 7 in the air discharge cycle, the controller 45 sets k=0 seconds in Operation S307 and then returns to Operation S302, but alternatively, abnormality may be informed by the alarming device, or the operation of the washing machine 1 may be stopped.

Moreover, the controller 45 may perform other operations, in which the clutch mechanism 19 is set to the second state and the motor 17 is driven to rotate only the pulsator 9, so as to bring the escaped laundry into the rotating tub 7, and it may perform a drain in Operation S307 and then returns to Operation S102. Even if such an operation is performed, since the detergent is not contained either in the water sprayed in the wetting cycle or in the water flowing out in Operation S307, it may be possible to save the detergent.

Also, in the water supply cycle executed by the controller 45 according to Embodiments 1 to 6 of the present disclosure, the controller 45 may determine that the water does not penetrate the laundry when a variance amount of the level of water before and after a predetermined amount of water is supplied is equal to or greater than a predetermined amount on the basis of a detection result of the water level sensor 13 and then execute again the air discharge cycle of Operation S104.

Further, in Embodiments 1 to 6 of the present disclosure, the motor 17 rotates the pulsator 9, but alternatively, it may rotate other pulsator including a disk member rotatably mounted on the inner bottom part of the rotating tub 7, and the like instead of the pulsator 9.

Moreover, in Embodiments 1 to 6 of the present disclosure, the rotational speed of each of the rotating tub 7 and the pulsator 9 is set to 60 rpm (in one example) in the wash cycle, but alternatively, a rotational speed may be selected and set among a plurality of speeds and the rotational speed of the rotating tub 7 in the air discharge cycle may be set to be faster than the selected rotational speed in the wash cycle.

Also, in Embodiment 4 of the present disclosure, an amount of the tap water sprayed by the spray nozzle 34 may become more toward a rear side (corresponding to a right side in FIG. 13), that is, an outer circumferential side of the rotating tub 7. Consequently, in Operation S101, the tap water is mainly sprayed over the laundry adhered to the inner lateral surface of the rotating tub 7 due to rotation thereof so that it is possible to uniformly spray the tap water over the laundry.

Hereinbefore, the configurations and features of the present disclosure have been described in detail with reference to the accompanying drawings.

In a conventional washing machine, when laundry is a feather product being likely to contain air, the laundry floats to a surface of water while the air is discharged and thus the air is not sufficiently discharged so that there is a problem in that contamination of the laundry is not sufficiently eliminated.

As is apparent from the above description, in accordance with the present disclosure, even when the laundry is a feather product, air contained in the laundry is discharged therefrom by a centrifugal force through the air discharge cycle and thus the laundry is prevented from floating to a surface of water so that there is an advantage in which washing may be more effectively performed.

The present disclosure may be useful in a single water tank type washing machine having a function of discharging air contained in the laundry.

Although the embodiments have been described with reference to specific embodiments and the accompanying drawings, various variations and modifications can be derived by those skilled in the art from the above description of the present disclosure. For example, it should be understood that an appropriate result may be achieved even when the techniques described herein may be performed in a different order than the described methods, and/or when components of the described systems, structures, devices, circuits, and the like are coupled or combined in a form different from the described methods, or substituted or replaced with other components or equivalents. Therefore, other embodiments and equivalents to the claims are within the scope of the following claims.

Although the present disclosure has been described with an exemplary embodiment, various changes and modifications may be suggested to one skilled in the art. It is intended that the present disclosure encompass such changes and modifications as fall within the scope of the appended claims.

The invention claimed is:

1. A washing machine comprising:

a rotating tub configured to accommodate laundry;

a water supply pipe configured to spray water over a surface of the laundry; and a controller configured to:

control an operation of each of the rotating tub and the water supply pipe, execute an air discharge cycle in which the rotating tub is rotated to discharge air contained in the laundry before a water supply cycle is started, execute the water supply cycle in which water is supplied to the rotating tub, and execute a wash cycle in which the laundry is washed, wherein, during the air discharge cycle, the rotating tub is rotated faster than a rotational speed in the wash cycle so as to discharge the air contained inside the laundry, and wherein the air discharge cycle precedes the water supply cycle and the wash cycle.

2. The washing machine of claim 1, wherein the controller is configured to execute a wetting cycle in which water is sprayed over the surface of the laundry when the air discharge cycle is terminated.

3. The washing machine of claim 1, wherein the controller is configured to execute a wetting cycle in which water is sprayed over the surface of the laundry before the air discharge cycle is executed, or executes the air discharge cycle and the wetting cycle simultaneously.

4. The washing machine of claim 2, wherein the controller is configured to control the water supply pipe to spray water toward an inner lateral surface of the rotating tub.

5. The washing machine of claim 4, wherein the controller is configured to control the water supply pipe to spray water from an upper part to a lower part of the rotating tub.

6. The washing machine of claim 4, wherein the controller is configured to control the water supply pipe to make a spray height of water, the spray height of water is sprayed toward the inner lateral surface of the rotating tub by the water supply pipe at 60% or more of a height of the rotating tub, or to make a spray width of water, and the spray width of water is sprayed over a bottom surface of the rotating tub at 90% or more of a length the rotating tub in a horizontal direction.

7. The washing machine of claim 2, further comprising:

a pulsator located inside the rotating tub, wherein the wetting cycle includes an operation in which at least one of the rotating tub and the pulsator is rotated.

8. The washing machine of claim 7, wherein the operation includes a first operation in which the pulsator is rotated to enable water accumulated inside the rotating tub to flow from an upper side to a lower side of the laundry.

9. The washing machine of claim 8, wherein the operation comprises a second operation, and the first operation and the second operation are alternately repetitively performed, wherein the rotating tub is fixed and only the pulsator is rotated in the second operation.

10. The washing machine of claim 7, wherein a rotational speed of the rotating tub or the pulsator is equal to or greater than 10 revolutions per minute (rpm) and equal to or less than 300 rpm in the wetting cycle.

11. The washing machine of claim 1, wherein a rotational speed of the rotating tub is equal to or greater than 300 rpm and equal to or less than 500 rpm in the air discharge cycle.

12. The washing machine of claim 1, wherein the water supply pipe includes a first water supply pipe configured to supply water to the rotating tub, and a second water supply pipe configured to spray water over the surface of the laundry.

13. The washing machine of claim 1, further comprising:

a detector configured to detect a weight of the laundry based on a rotational speed of the rotating tub.

14. The washing machine of claim 1, further comprising:

a display configured to display a state of the washing machine, wherein the display is configured to display the air discharge cycle and a wetting cycle differently than other cycles executed by the washing machine.

15. The washing machine of claim 1, wherein the water supply pipe comprises:

a first water supply pipe including a spray nozzle configured to spray water over the surface of the laundry; and a second water supply pipe configured to supply water to the rotating tub.

16. A controlling method of a washing machine, comprising:

an air discharge cycle for rotating a rotating tub to discharge air contained inside laundry inside the rotating tub;

a water supply cycle for supplying water to the rotating tub; and a wash cycle for washing the laundry inside the rotating tub, wherein, during the air discharge cycle, the rotating of the rotating tub is faster than a rotational speed of the rotating tub during the wash cycle so as to discharge the air contained inside the laundry before the water supply cycle is terminated, and wherein the air discharge cycle precedes the water supply cycle and the wash cycle.

17. The controlling method of claim 16, further comprising:

a wetting cycle for spraying water over a surface of the laundry when the air discharge cycle is terminated.

18. The controlling method of claim 16, further comprising:

a wetting cycle for spraying water over a surface of the laundry before the air discharge cycle is executed.

19. The controlling method of claim 16, wherein a rotational speed of the rotating tub in the air discharge cycle is equal to or greater than 300 rpm and equal to or less than 500 rpm.

20. The controlling method of claim 17, further comprising displaying and indicating the air discharge cycle and the wetting cycle differently than other cycles executed by the washing machine.

* * * * *